US011959339B2

(12) United States Patent
Ladwig et al.

(10) Patent No.: US 11,959,339 B2
(45) Date of Patent: Apr. 16, 2024

(54) CEMENTING ADAPTER SYSTEMS AND METHODS

(71) Applicant: McClinton Energy Group, LLC, Midland, TX (US)

(72) Inventors: Aaron Ladwig, Midland, TX (US); Jeremy Perkins, Midland, TX (US); Tommy McClinton, Midland, TX (US)

(73) Assignee: MCCLINTON ENERGY GROUP, LLC, Midland, TX (US)

( * ) Notice: Subject to any disclaimer, the term of this patent is extended or adjusted under 35 U.S.C. 154(b) by 409 days.

(21) Appl. No.: 17/125,670

(22) Filed: Dec. 17, 2020

(65) Prior Publication Data

US 2022/0195810 A1 Jun. 23, 2022

(51) Int. Cl.

| | |
|---|---|
| ***E21B 17/046*** | (2006.01) |
| ***E21B 17/042*** | (2006.01) |
| ***E21B 19/22*** | (2006.01) |
| ***E21B 33/05*** | (2006.01) |

(52) U.S. Cl.

CPC ..... *E21B 17/046* (2013.01); *E21B 17/042* (2013.01); *E21B 19/22* (2013.01); *E21B 33/05* (2013.01)

(58) Field of Classification Search

CPC ..... F16L 21/06; F16L 21/065; F16L 23/036; F16L 23/08; E21B 17/046; E21B 17/042; E21B 33/05; E21B 33/14

See application file for complete search history.

(56) References Cited

U.S. PATENT DOCUMENTS

| | | | | | |
|---|---|---|---|---|---|
| 3,545,542 | A * | 12/1970 | Scott | E21B 33/05 | 166/155 |
| 3,616,850 | A * | 11/1971 | Scott | E21B 33/16 | 166/70 |
| 4,246,967 | A * | 1/1981 | Harris | E21B 33/05 | 15/104.062 |
| 4,524,998 | A * | 6/1985 | Brisco | E21B 33/05 | 285/388 |
| 4,574,882 | A * | 3/1986 | Szarka | E21B 33/05 | 166/70 |
| 5,441,310 | A * | 8/1995 | Barrett | F16L 37/002 | 285/308 |
| 5,642,782 | A * | 7/1997 | Grimshaw | E21B 33/0415 | 166/242.6 |
| 5,950,725 | A * | 9/1999 | Rondeau | E21B 33/16 | 166/70 |
| 6,302,140 | B1 * | 10/2001 | Brisco | E21B 33/05 | 137/268 |

(Continued)

*Primary Examiner* — David Bochna

(74) *Attorney, Agent, or Firm* — Nolte Lackenbach Siegel

(57) ABSTRACT

A system for connecting a cement string for a cementing operation, the system may include a casing spool and a lower quick connector attached to the casing spool, the lower quick connector comprising a lower body having an inner surface and at least one sealing element disposed on the inner surface of the lower body. The system may also include a cement adapter removably connected to the lower quick connector, the cement adapter comprising a cement adapter body having an outer edge that engages at least one sealing element and a radial protrusion extending outwardly from the cement adapter body and a connector clamp that engages the lower quick connector and the cement adapter to hold the cement adapter in place relative to the lower quick connector.

24 Claims, 9 Drawing Sheets

(56) References Cited

U.S. PATENT DOCUMENTS

| | | | | |
|---|---|---|---|---|
| 6,578,881 | B2 * | 6/2003 | Lynn | H01J 37/3435 285/354 |
| 6,597,175 | B1 * | 7/2003 | Brisco | E21B 33/16 324/326 |
| 7,475,721 | B2 * | 1/2009 | McGuire | E21B 33/03 166/85.1 |
| 8,505,984 | B2 * | 8/2013 | Henderson | E21B 17/046 285/376 |
| 8,740,260 | B1 * | 6/2014 | Liew | E21B 17/046 285/364 |
| 10,494,878 | B2 | 12/2019 | Scott et al. | |
| 10,648,243 | B1 * | 5/2020 | Burrows | E21B 17/046 |
| 2004/0046387 | A1 * | 3/2004 | Niven | F16L 37/002 285/320 |
| 2010/0264648 | A1 * | 10/2010 | Guidry | E21B 17/046 285/325 |
| 2015/0041116 | A1 * | 2/2015 | Beisel | E21B 17/02 29/464 |
| 2016/0348449 | A1 * | 12/2016 | MacGregor | E21B 17/046 |
| 2017/0067320 | A1 * | 3/2017 | Zouhair | E21B 3/022 |
| 2019/0301260 | A1 * | 10/2019 | Kibler | E21B 17/046 |
| 2023/0010738 | A1 * | 1/2023 | Bayyouk | F16L 23/08 |

* cited by examiner

CEMENTING ADAPTER SYSTEMS AND METHODS

BACKGROUND

The hydrocarbon industries, during drilling, completion, and production operations, use various types of equipment that include, for example, wellheads and blowout preventers. More specifically, wellheads and blowout preventers are typically used in conjunction with the drilling rig in cementing operations during completion phases of well construction. Prior to production of a well, the well may be cemented to seal the annulus between a casing and the walls of a wellbore after a casing string has been run down hole. The cementing may, for example, seal a lost circulation zone. Cement may also be used to set a plug in an existing well or to plug a well so that it may be abandoned. Cementing operations may be used to seal intermediate casing strings and various types of production strings.

In order to pump cement into a well, the casing or landing joints with special end adapters are run through the blowout preventer to fluidly connect the cementing equipment on the rig floor to the casing string inside the wellhead. The blowout preventer may be a part of a blowout preventer stack including other pieces of equipment. Conventionally, a blowout preventer is fluidly connected to the wellhead by means of a flange on the casing head or casing spool which is secured using threaded studs and nuts. These flanged connections are time consuming to install and slow the transition of a blowout preventer between various wells. Special adapters are commonly utilized to reduce the connection time by utilizing various clamps, bolts, or threaded mechanisms to secure the blowout preventor to the wellhead.

BRIEF SUMMARY OF THE INVENTION

According to one aspect of one or more embodiments of the present invention, system for connecting a cement string for a cementing operation, the system may include a casing spool and a lower quick connector attached to the casing spool, the lower quick connector comprising a lower body having an inner surface and at least one sealing element disposed on the inner surface of the lower body. The system may also include a cement adapter removably connected to the lower quick connector, the cement adapter comprising a cement adapter body having an outer edge that engages at least one sealing element and a radial protrusion extending outwardly from the cement adapter body and a connector clamp that engages the lower quick connector and the cement adapter to hold the cement adapter in place relative to the lower quick connector.

According to one aspect of one or more embodiments of the prevent invention, a method for adapting a wellhead for a cementing job, the method may include removing a connector clamp from an upper quick connector attached to a blowout preventer and a lower quick connector that is attached to the wellhead, removing the upper quick connector from the lower quick connector, and engaging slidably a cement adapter on top of the lower quick connector, the placing comprising engaging the cement adapter with an upper shoulder of the lower quick connector. The method may also include attaching the connector clamp to the cement adapter and the lower quick connector around an outer edge of the cement adapter and an outer edge of the lower quick connector and securing the connector clamp with at least one mechanical attachment.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Illustrative examples of the subject matter claimed below will now be disclosed. In the interest of clarity, not all features of an actual implementation are described for every example in this specification. It will be appreciated that in the development of any such actual implementation, numerous implementation-specific decisions may be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Further, as used herein, the article "a" is intended to have its ordinary meaning in the patent arts, namely "one or more." Herein, the term "about" when applied to a value generally means within the tolerance range of the equipment used to produce the value, or in some examples, means plus or minus 10%, or plus or minus 5%, or plus or minus 1° A, unless otherwise expressly specified. Further, the term "substantially" as used herein means a majority, or almost all, or all, or an amount with a range of about 51° A to about 100%, for example. Moreover, examples herein are intended to be illustrative only and are presented for discussion purposes and not by way of limitation.

Embodiments of the present disclosure may provide systems and methods for quickly adapting a wellhead for offline cementing jobs where a rig and blowout preventer may be moved between multiple wells. Additionally, the systems and methods may include slidably engaging cement adapters, that allow cementing connections to more quickly be attached to wellheads than conventional bolt on and threadable connections.

Additionally, systems and methods disclosed herein may use connector clamps that are disposed around the quick connection modules that allow an operator to secure the quick connection modules in a relatively fast and safe manner. The use of such connector clamps facilitates a faster transition between components of a wellhead stack. By facilitating a faster transition between wellhead components through the use of quick connection modules, offline cementing jobs may transition between various wells more efficiently. Various types of quick connection modules will be discussed in detail below.

Figure 1:
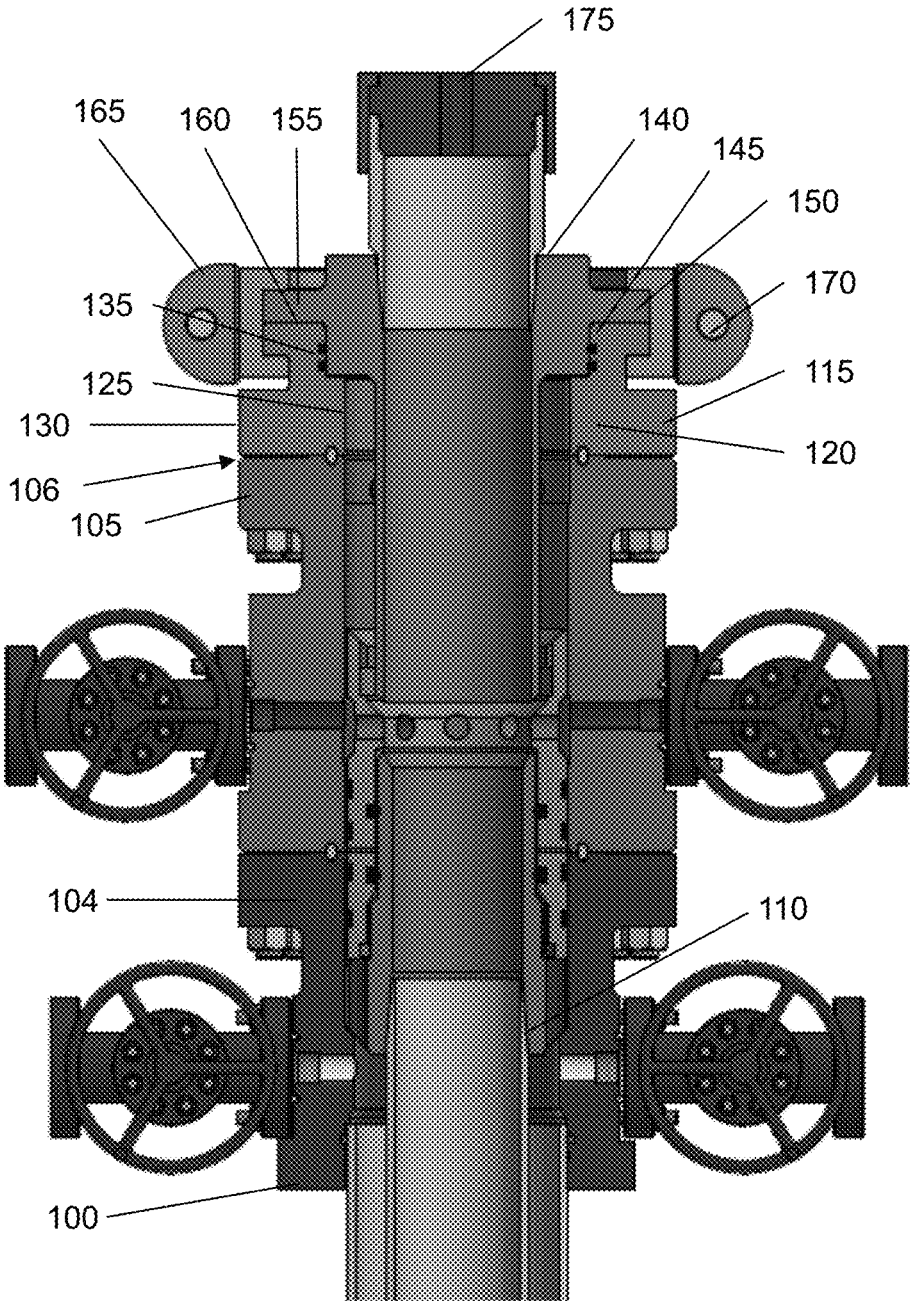
FIG. 1 is a side cross-sectional view of a wellhead according to embodiments of the present disclosure.

Turning to FIG. 1, a side cross-sectional view of a wellhead according to embodiments of the present disclosure is shown. In this embodiment, a wellhead 100 is illustrated. The wellhead 100 may be used in offline cementing operations for an intermediate string. Offline cementing operations provide the ability to cement casing off of a rig, thereby allowing the rig to move to other wells to provide other operations, such as drilling or other cementing operations.

Casing head 104 is fluidly connected to a casing spool 105. Casing spool 105 may be used to control wellhead pressure and provide a connection point for an upper end of a casing string 110. Casing spool 105 may be bolted to casing head 110 using a plurality of bolts or may otherwise be mechanically attached to casing head 110.

A proximate, upper end 106 of casing spool 105 may be connected to a lower quick connector 115. Casing spool 105 and lower quick connector 115 may be connected through various mechanical attachments, such as a plurality of bolts. Lower quick connector 115 may have a lower body 120 that includes an inner surface 125 and an outer edge 130. One or more sealing elements 135 may be disposed on the inner surface 125. Sealing elements 135 may be formed from, for example, an elastomeric material, such as rubber, plastics, composites, and the like. In some embodiments, the sealing elements 135 may be elastomeric O-rings, although other types of sealing elements may be used in other embodiments.

Lower quick connector 115 may further be connected to a cement adapter 140. Cement adapter 140 may be removably inserted into lower quick connector 115 without requiring mechanical attachment mechanisms, such as threads, bolts, or the like. Cement adapter 140 includes a cement adapter body 145 that has an outer edge 150 that may engage sealing elements 135. Cement adapter 140 may also include a radial protrusion 155 that extends outwardly from cement adapter body 145. Radial protrusion 155 may rest on an upper edge 160 of lower quick connector 115 thereby providing engagement therebetween when makeup is complete.

To hold cement adapter 140 in place with lower quick connector 115, a connector clamp 165 may be attached thereto. Connector clamp 165 may have a C-shaped, cross-sectional inner geometry that engages both cement adapter 140 and lower quick connector 115, which when engaged forms a corresponding rectangular-shaped cross-sectional geometry. After the connector clamp 165 is installed about cement adapter 140 and lower quick connector 115, bolts or other mechanical attachments may be inserted into corresponding eyeholes 170. After tightening connector clamp 165 in a manner described more fully below, a completed connection may be formed and cement adapter 140 is securely connected to lower quick connector 115. With the connection formed, various cementing devices 175 may be connected to cement adapter 140, thereby allowing cementing operations to commence.

Certain aspects of this system may be made up offsite, while other aspects may be made up in the field. For example, casing spool 105 and lower quick connector 115 may be connected in a manufacturing facility or in an area away from the well. However, cement adapter 140, as well as other aspects that will be discussed in greater detail below may be assembled at a wellhead or proximate a drilling or production location. Accordingly, casing spool 105 and lower quick connector 115 may be connected to casing head 100 separately from other connections, such as the connection with cement adapter 140.

By providing a system that allows for removable and slidable connections between cement adapter 140 and lower quick connector 115, as well as using connector clamp 165 to secure cement adapter 140 and lower quick connector 115 a system for quickly adapting wellhead 100 for various operations may be provided. Such systems may save time, money, and facilitate the transference of blowout preventer (not shown) and other components thereof around a drilling and/or production field having one or more wells. Detailed explanations of specific components are provided below.

Figure 2:
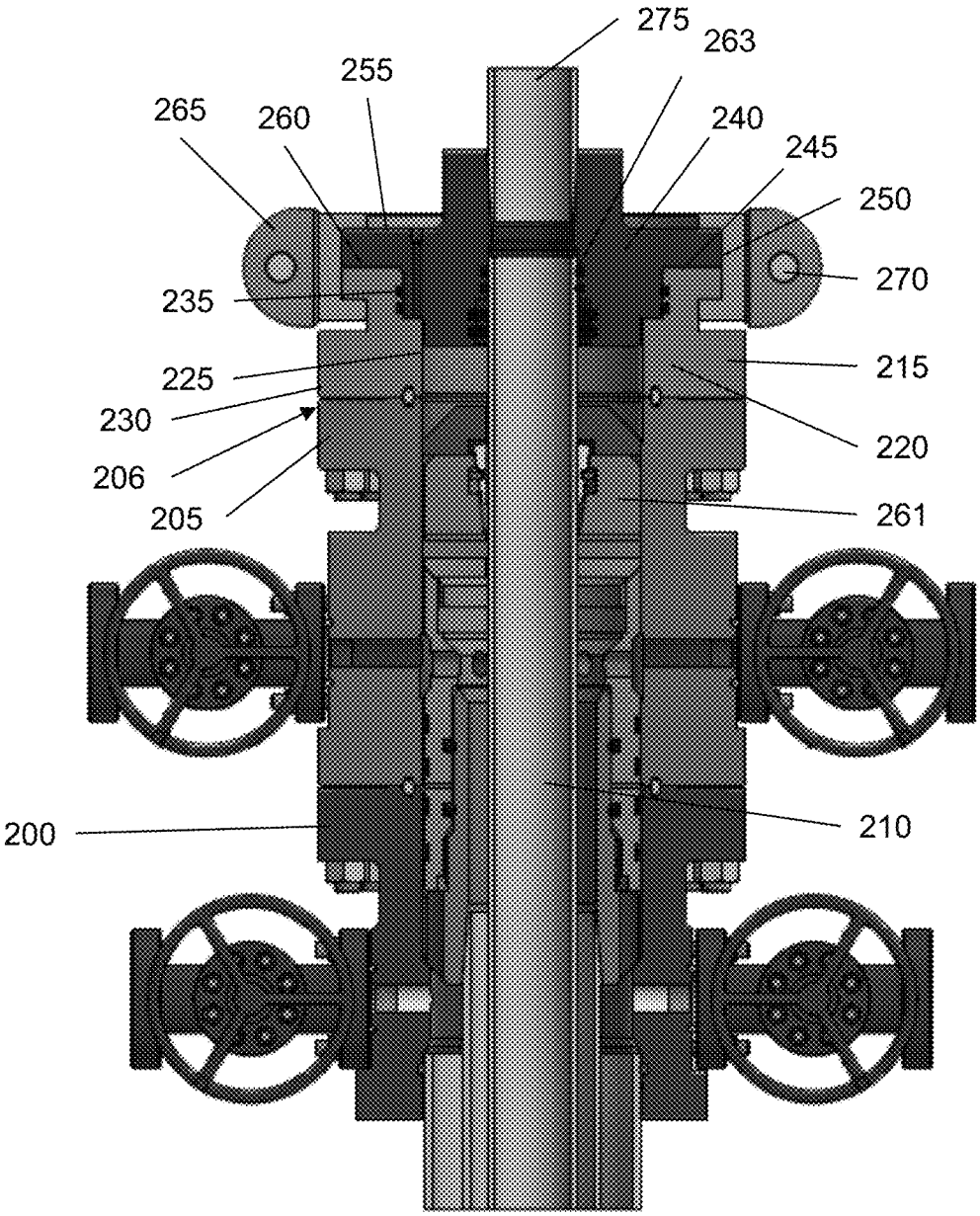
FIG. 2 is a side cross-sectional view of a wellhead according to embodiments of the present disclosure.

Turning to FIG. 2, a side cross-sectional view of a wellhead according to embodiments of the present disclosure is shown. In this embodiment, a casing head 200 is illustrated, which may be used in offline cementing operations for a production string, such as a production string with a slip hanger 261. Casing head 200 is fluidly connected to a casing spool 205. Casing spool 205 may be bolted to blowout preventer 200 using a plurality of bolts or may otherwise be mechanically attached to blowout preventer 200.

A proximate, upper end 206 of casing spool 205 may be connected to a lower quick connector 215. Casing spool 205 and lower quick connector 215 may be connected through various mechanical attachments, such as a plurality of bolts. Lower quick connector 215 may have a lower body 220 that includes an inner surface 225 and an outer edge 230. One or more sealing elements 235 may be disposed on the inner surface 225. Sealing elements 235 may be formed from, for example, an elastomeric material, such as rubber, plastics, composites, and the like Lower quick connector 215 may further be connected to a cement adapter 240. Cement adapter 240 may be removably inserted into lower quick connector 215 without requiring mechanical attachment mechanisms, such as threads, bolts, or the like. Cement adapter 240 includes a cement adapter body 245 that has an outer edge 250 that may engage sealing elements 235. Cement adapter 240 may also include a radial protrusion 255 that extends outwardly from cement adapter body 245. Radial protrusion 255 may rest on an upper edge 260 of lower quick connector 215 thereby providing a seal therebetween when makeup is complete. Cement adapter 240 may also include one or more seals 263 that seal cement adapter 240 against a casing string 210.

To hold cement adapter 240 in engagement with lower quick connector 215, a connector clamp 265 may be attached thereto. Connector clamp 265 may have a C-shaped cross-sectional inner geometry that engages both cement adapter 240 and lower quick connector 215, which when engaged forms a corresponding rectangular-shaped cross-sectional geometry. After the connector clamp 265 is installed about cement adapter 240 and lower quick connector 215, bolts or other mechanical attachments may be inserted into corresponding eyeholes 270. After tightening, connector clamp 165 in a manner described more fully below, a completed connection may be formed and cement adapter 240 is securely connected to lower quick connector 215. With the connection formed, various cementing devices 275 may be connected to cement adapter 240, thereby allowing cementing operations to commence.

Figure 3:
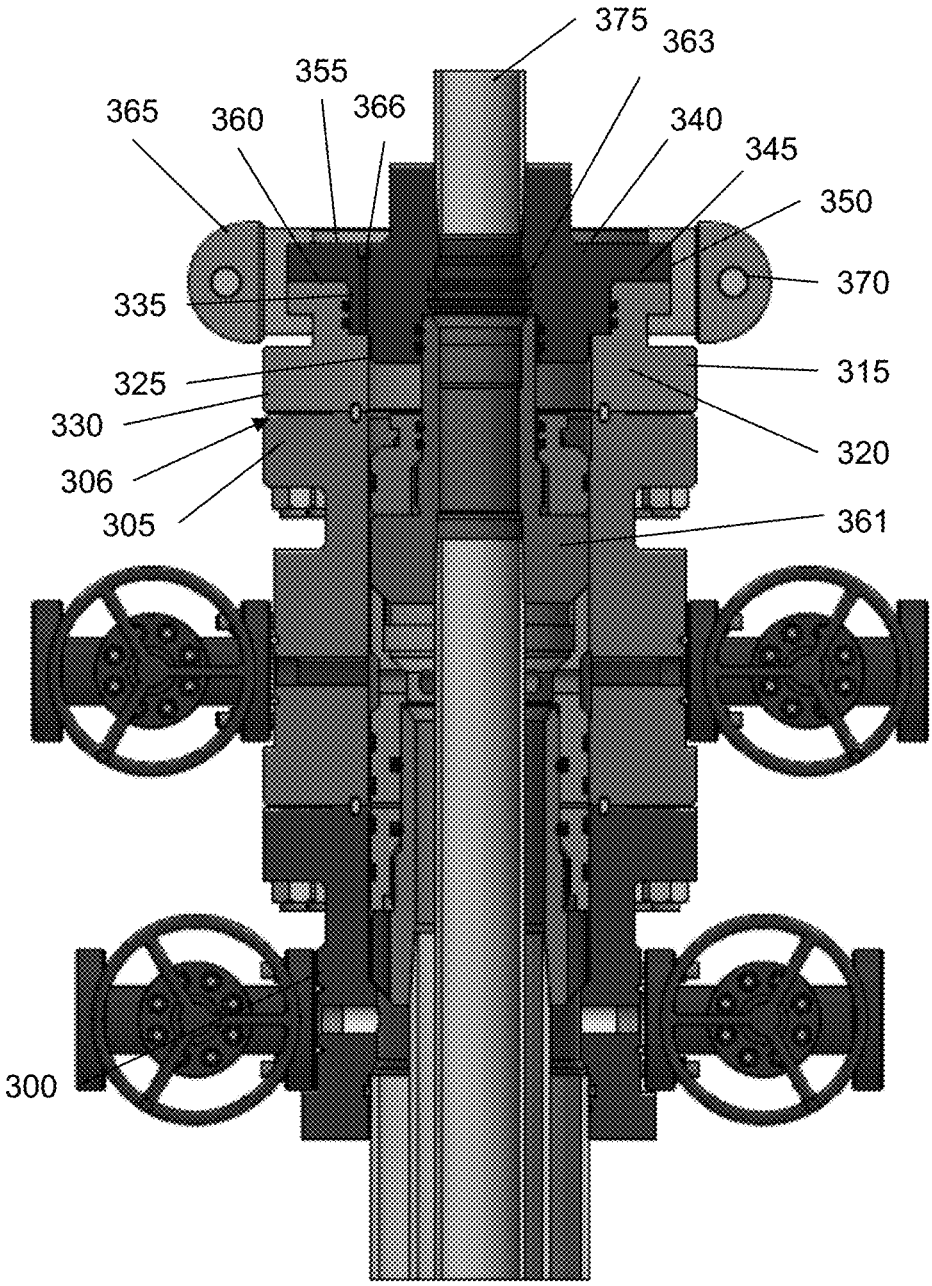
FIG. 3 is a side cross-sectional view of a wellhead according to embodiments of the present disclosure.

Turning to FIG. 3, a side cross-sectional view of a wellhead according to embodiments of the present disclosure is shown. In this embodiment, a casing head 300 is illustrated, which may be used in offline cementing operations for a production string, such as a production string with a mandrel hanger 361. wellhead 300 is fluidly connected to a casing spool 305. Casing spool 305 may be bolted to casing head 300 using a plurality of bolts or may otherwise be mechanically attached to casing head 300.

A proximate, upper end 106 of casing spool 305 may be connected to a lower quick connector 315. Casing spool 305 and lower quick connector 315 may be connected through various mechanical attachments, such as a plurality of bolts. Lower quick connector 315 may have a lower body 320 that includes an inner surface 325 and an outer edge 330. One or more sealing elements 335 may be disposed on the inner surface 325. Sealing elements 335 may be formed from, for example, an elastomeric material, such as rubber, plastics, composites, and the like.

Lower quick connector 315 may further be connected to a cement adapter 340. Cement adapter 340 may be removably inserted into lower quick connector 315 without requiring mechanical attachment mechanisms, such as threads, bolts, or the like. Cement adapter 340 includes a cement adapter body 345 that has an outer edge 350 that may engage sealing elements 335. Cement adapter 340 may also include a radial protrusion 355 that extends outwardly from cement adapter body 345. Radial protrusion 355 may rest on an upper edge 360 of lower quick connector 315 thereby providing a seal therebetween when makeup is complete. Cement adapter 340 may also include one or more seals 363 that seal cement adapter 340 against a casing string 364. In certain embodiments, cement adapter 340 may also include a pressure port 366. Pressure port 366 may be disposed through cement adapter body 345 and may allow pressure to be relieved before or during makeup and may be used to test pressure during operation.

To hold cement adapter 340 in engagement with lower quick connector 315, a connector clamp 365 may be attached thereto. Connector clamp 365 may have a C-shaped cross-sectional inner geometry that engages both cement adapter 340 and lower quick connector 315, which when engaged forms a corresponding square-shaped cross-sectional geometry. After the connector clamp 265 is installed about cement adapter 340 and lower quick connector 315, bolts or other mechanical attachments may be inserted into corresponding eyeholes 370. After tightening, a completed connection may be formed and cement adapter 340 is securely connected to lower quick connector 315. With the connection formed, various cementing devices 375 may be connected to cement adapter 340, thereby allowing cementing operations to commence.

Figure 4:
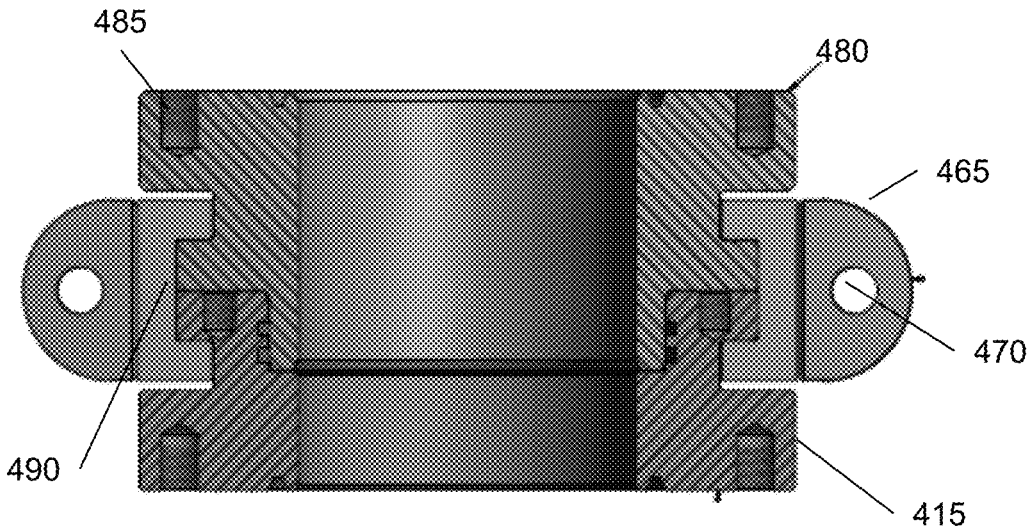
FIG. 4 is a cross-sectional view of a quick connector for attaching a blowout preventer to a wellhead according to embodiments of the present disclosure.
Figure 5:
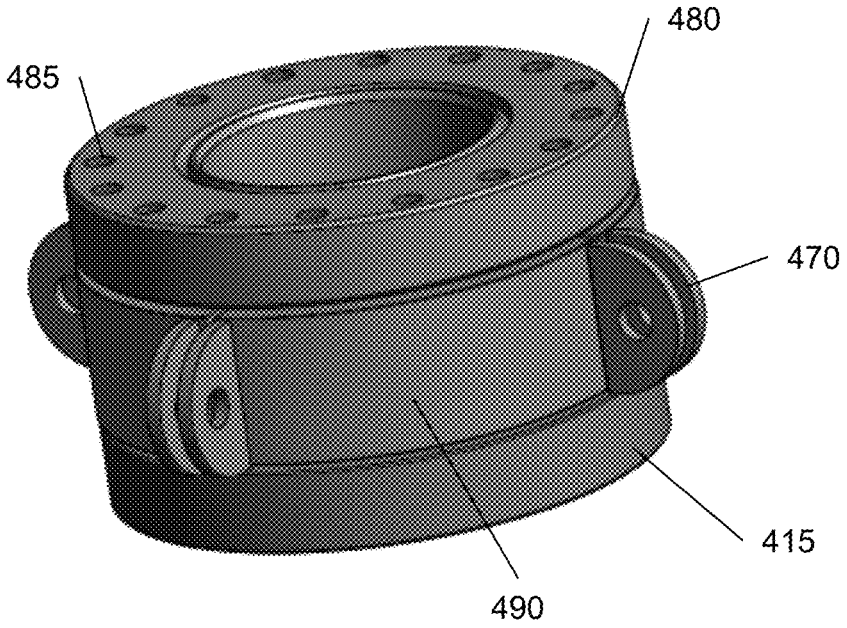
FIG. 5 is an elevated perspective view of a quick connector for attaching a blowout preventer to a wellhead according to embodiments of the present disclosure.

Turning to FIGS. 4 and 5 together, a cross-sectional view of an complete quick connector assembly for a blowout preventer and an elevated perspective view of an complete quick connector assembly, respectively, according to embodiments of the present disclosure are shown. In this aspect, an upper adapter 480 is illustrated that may be connected to a blowout preventer (not shown), as the blowout preventer is moved between wells. Note that, for this reason, the upper quick connector is not shown in FIGS. 1-3. As with the above, system 400 includes a lower quick connector 415 that is connected to an upper quick connector 480 through a clamp connector 465. The connection between lower quick connector 415 and a casing spool (not shown) or other aspect of a wellhead is the same as described above with respect to FIGS. 1-3. Similarly, the engagement of clamp connector 465 with lower quick connector 415 and upper quick connector 480 is the same as the connector with lower quick connector 415 and a cement adapter (not shown) as described with respect to FIGS. 1-3.

Upper quick connector 480 includes a plurality of apertures 485. Apertures 485 may include threadable connections for receiving bolts or other mechanical devices that allow for lifting upper quick connector 480 off lower quick connector in order to install other quick connections, such as a cement adapter. Upper quick connector 480 is connected to a blowout preventer as the blowout preventer is moved between wells.

Turning specifically to FIG. 5, a plurality of apertures 485 are illustrated around a top portion of upper quick connector 480. Additionally, the clamp connector 465 is illustrated as having a plurality of connection portions 490, each with an eyehole 470. As discussed above, mechanical attachment mechanisms, such as bolts may be inserted through corresponding eyeholes 470 and tightened in order to secure lower quick connection 415 and upper quick connection 480. The number of connection portions 490 may vary depending on the diameter of other components, pressure, or other design variables. Generally, two, three, four, or more connection portions 490 may be used.

Figure 6:
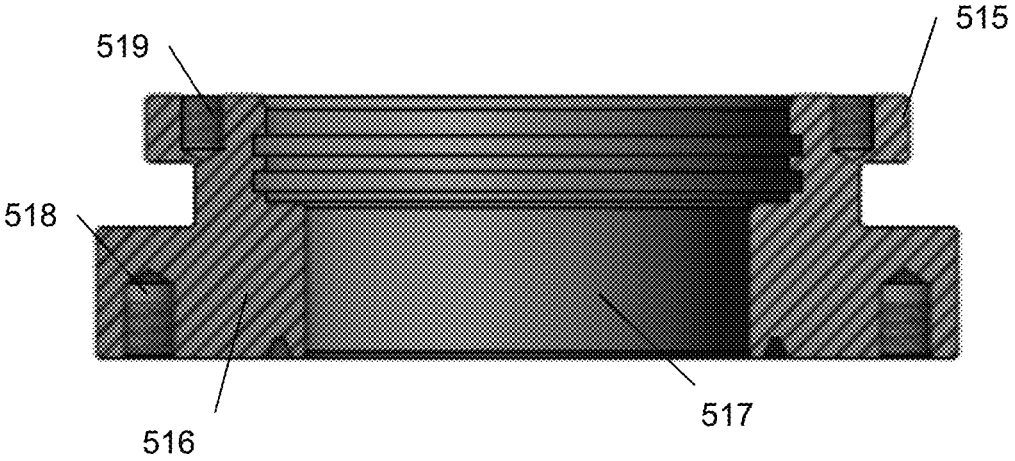
FIG. 6 is a cross-sectional view of a lower quick connector for a wellhead according to embodiments of the present disclosure.

Turning to FIG. 6, a cross-sectional view of a lower quick connector for a wellhead according to embodiments of the present disclosure is shown. Lower quick connector 515 includes a lower body 516 through which a central bore 517 provides a passage therethrough. Lower quick connector 515 also includes a plurality of apertures 518 that allow lower quick connector 515 to be attached to other wellhead (not shown) components, such as a casing spool (not shown), as discussed above with respect to FIGS. 1-3. A second plurality of apertures 519 are located on a proximate, top side, of lower quick connector 515.

Second plurality of apertures 519 may be used when installing other components, such as a cement adapter (not shown). During assembly, a cement adapter, or other components may be placed into contact with lower quick connector 515. Mechanical attachments, such as bolts, may be used to aid with installation of the cement adapter. Once assembled in place, the mechanical attachments may then be removed and a connector clamp may be installed, which will hold the cement connector and lower quick connector 515 in place during operation.

Figure 7:
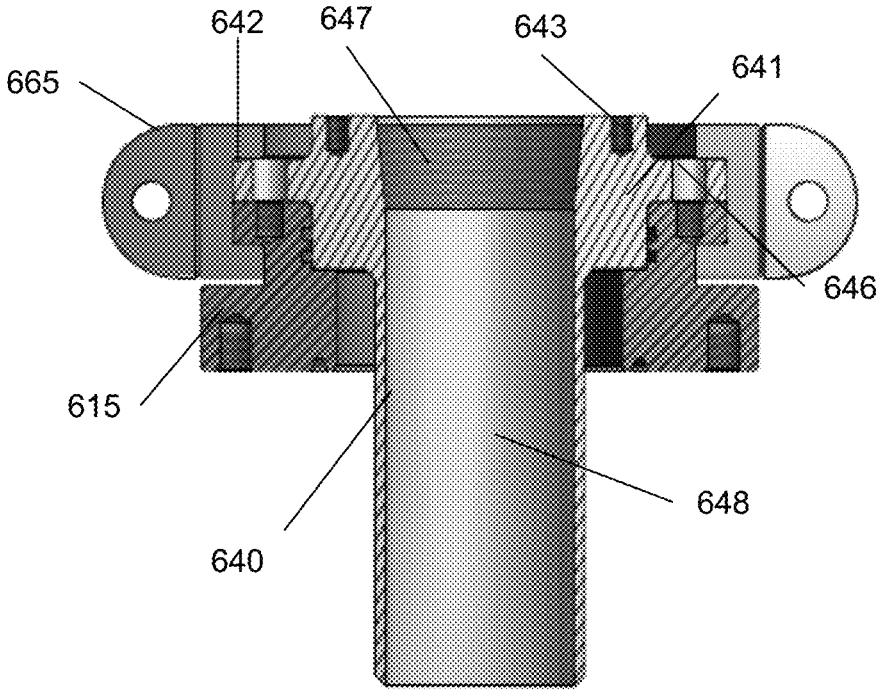
FIG. 7 is a cross-sectional view of an intermediate string offline cement adapter for a wellhead according to embodiments of the present disclosure.
Figure 8:
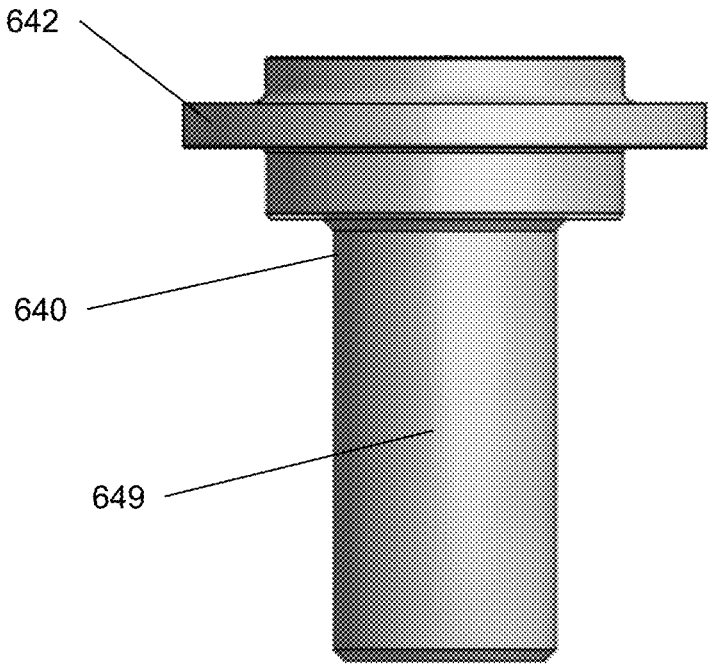
FIG. 8 is a side, plan view of an intermediate string offline cement adapter for a wellhead according to embodiments of the present disclosure.
Figure 9:
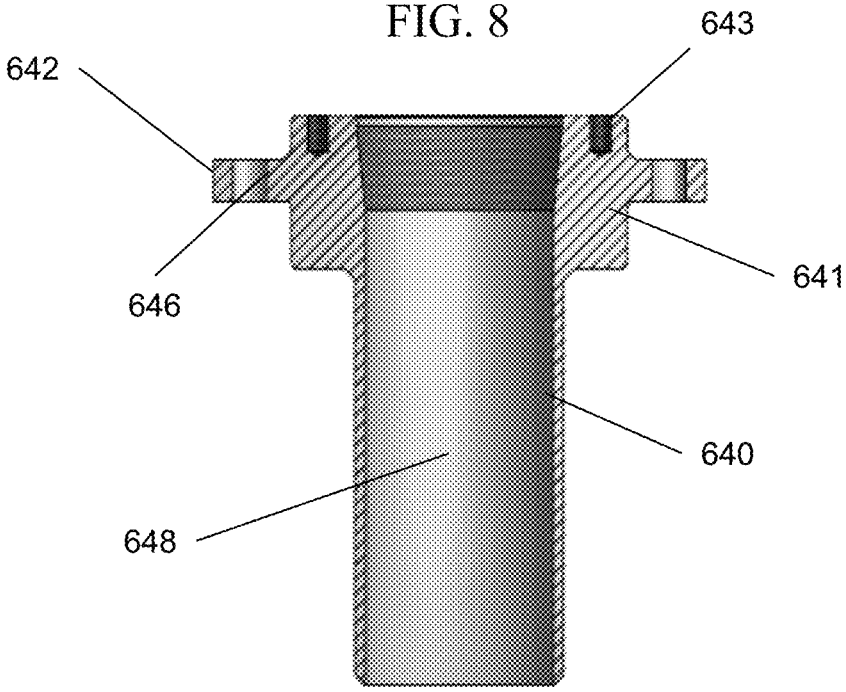
FIG. 9 is a cross-sectional view of an intermediate string offline cement adapter for a wellhead according to embodiments of the present disclosure.
Figure 10:
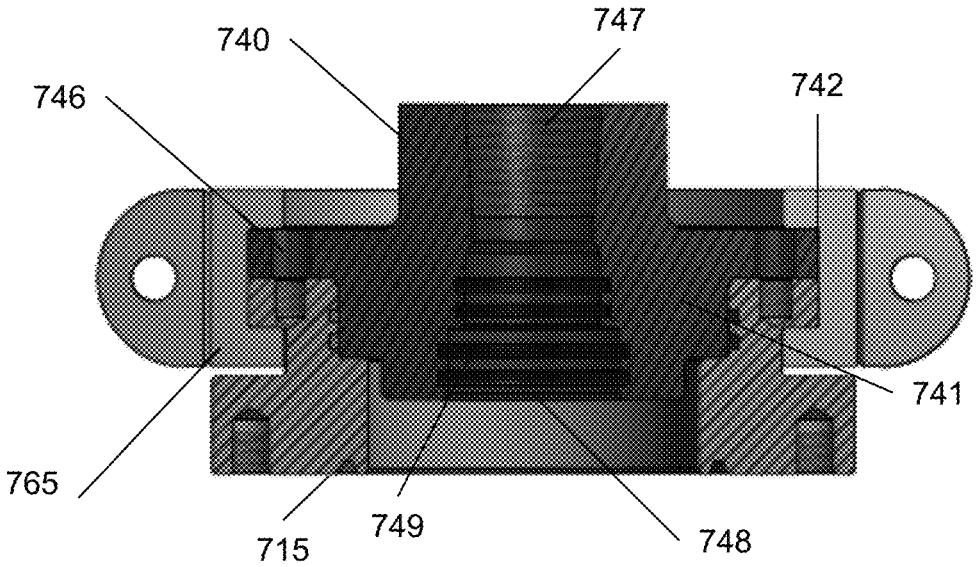
FIG. 10 is a cross-sectional view of a production string offline cement adapter for a wellhead attached to a lower quick connector using a connector clamp according to embodiments of the present disclosure.
Figure 11:
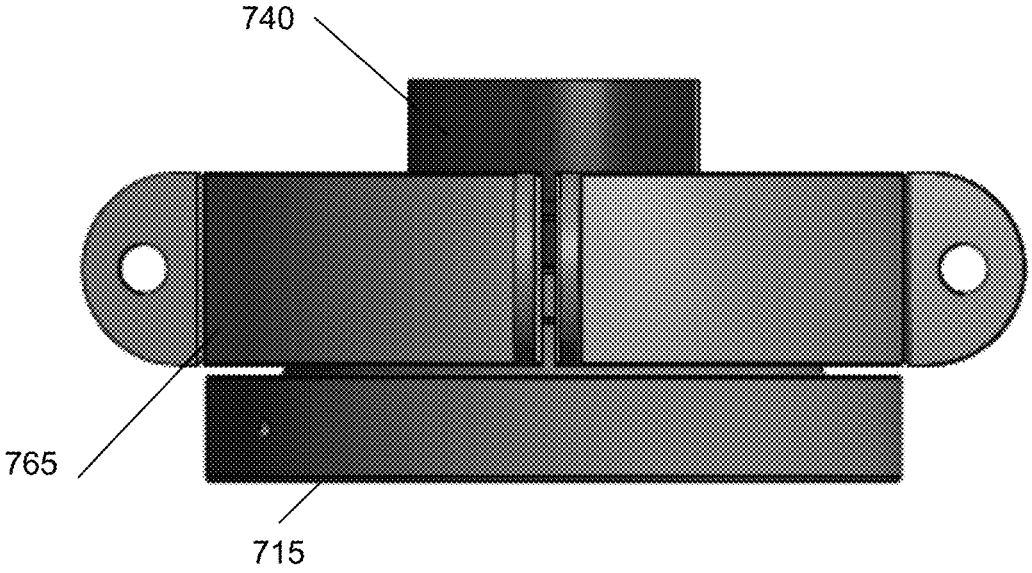
FIG. 11 is a side, plan view of a production string offline cement adapter for a wellhead attached to a lower quick connector using a connector clamp according to embodiments of the present disclosure.
Figure 12:
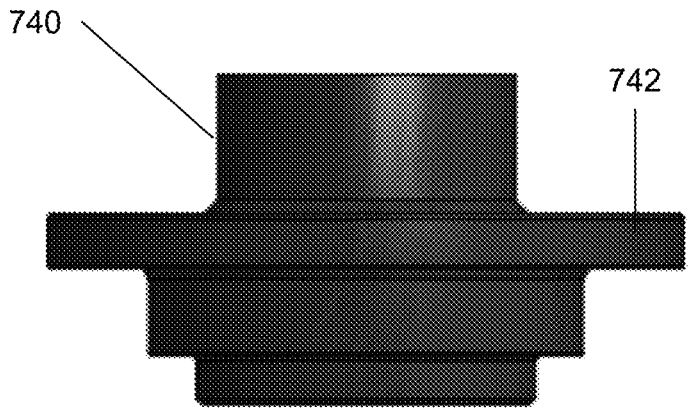
FIG. 12 is a side, plan view of a production string offline cement adapter for a wellhead according to embodiments of the present disclosure.

Turning to FIGS. 7, 8, and 9, a cross-sectional view of a cement adapter for a wellhead, a side view of a lower quick connector for a wellhead, and another cross-sectional view of a cement connector for a wellhead, respectively, according to embodiments of the present disclosure are shown. In this aspect, a cement adapter 640 is illustrated, and specifically with respect to FIG. 7, cement adapter 640 is illustrated installed within a lower quick connector 615. Cement adapter 640 may be used in operations such as those discussed with respect to FIG. 1. More specifically, cement adapter 640 is a short string cement adapter.

Cement adapter 640 includes a cement adapter body 641, a radial protrusion 642, and a cementing bore 648. Cementing bore 648 may provide a central passage through cement adapter 640, thereby providing fluid communication between cementing equipment (not shown) and a well. Cement adapter 640 also includes a longitudinal extension 649 that extends below lower quick connector 615 that provides fluid communication between cementing equipment (not shown) and a well (not shown). The length of longitudinal extension 649 may vary according to operational requirements, and may be present in various embodiments, such as those discussed above with respect to FIGS. 1-3.

A plurality of cement adapter apertures 643 are disposed on a proximate, top end, of cement adapter 640. Plurality of cement adapter apertures 643 may be used during installation and removal to receive mechanical attachments that allow for the lifting of cement adapter 640 off a wellhead (not shown). The mechanical attachments may include loops, eyeholes, or the like that allow lifting tools, such as chains, cables, ropes, etc., to be attached thereto, thus allowing cement adapter 640 to either be installed or removed from the wellhead.

Cement adapter 640 also includes a plurality of installation apertures 646, which provide a path for mechanical attachments, such as bolts, to pass through, thereby allowing the mechanical attachments to engage lower quick connector 615. As discussed above, the mechanical attachments may be used during installation to initially secure cement adapter 640 to lower quick connector 615. After securing cement adapter 640 to lower quick connector 615, the mechanical attachments may be removed and connector clamp 665 may be secured around cement adapter 640 and lower quick connector 615. In certain embodiments, cement adapter 640 may also include threads 647, or other securing devices, thereby allowing cementing equipment to be attached thereto.

Turning to FIGS. 10, 11, 12, and 13 various view of a cement adapter and a cement adapter attached to a lower quick connector according to embodiments of the present disclosure are shown. In this aspect, a cement adapter 740 is illustrated installed within a lower quick connector 715. Cement adapter 740 may be used in operations such as those discussed with respect to FIG. 2. More specifically, cement adapter 740 is a production string cement adapter 740 that may be used with a slip hanger (not shown) or mandrel hanger (not shown).

Cement adapter 740 includes a cement adapter body 741, a radial protrusion 742, and a cementing bore 748. Cementing bore 748 may provide a central passage through cement adapter 740, thereby providing fluid communication between cementing equipment (not shown) and a well. A plurality of cement adapter apertures 743 are disposed on a proximate, top end, of cement adapter 740.

Cement adapter 740 also includes a plurality of installation apertures 746, which provide a path for mechanical attachments, such as bolts, to pass through, thereby allowing the mechanical attachments to engage lower quick connector 715. As discussed above, the mechanical attachments may be used during installation to initially secure cement adapter 740 to lower quick connector 715. After securing cement adapter 740 to lower quick connector 715, the mechanical attachments may be removed and connector clamp 765 may be secured around cement adapter 740 and lower quick connector 715. In certain embodiments, cement adapter 740 may also include threads 747, or other securing devices, thereby allowing cementing equipment to be attached thereto. Cement adapter 740 may also include one or more sealing elements 749 disposed around cementing bore 748.

Figure 13:
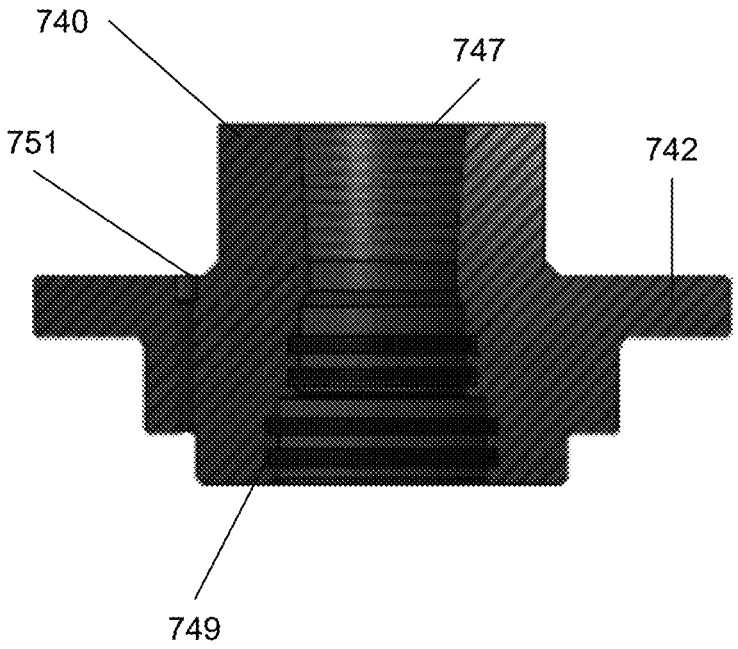
FIG. 13 is a cross-sectional view of a production string offline cement adapter for a wellhead according to embodiments of the present disclosure.

Specifically, with respect to FIG. 13, a cement adapter 740 has a pressure port 751. Pressure port 751 may be used to relieve pressure during or after installation. Pressure port 751 may also be used to test pressure during cementing operations.

Figure 14:
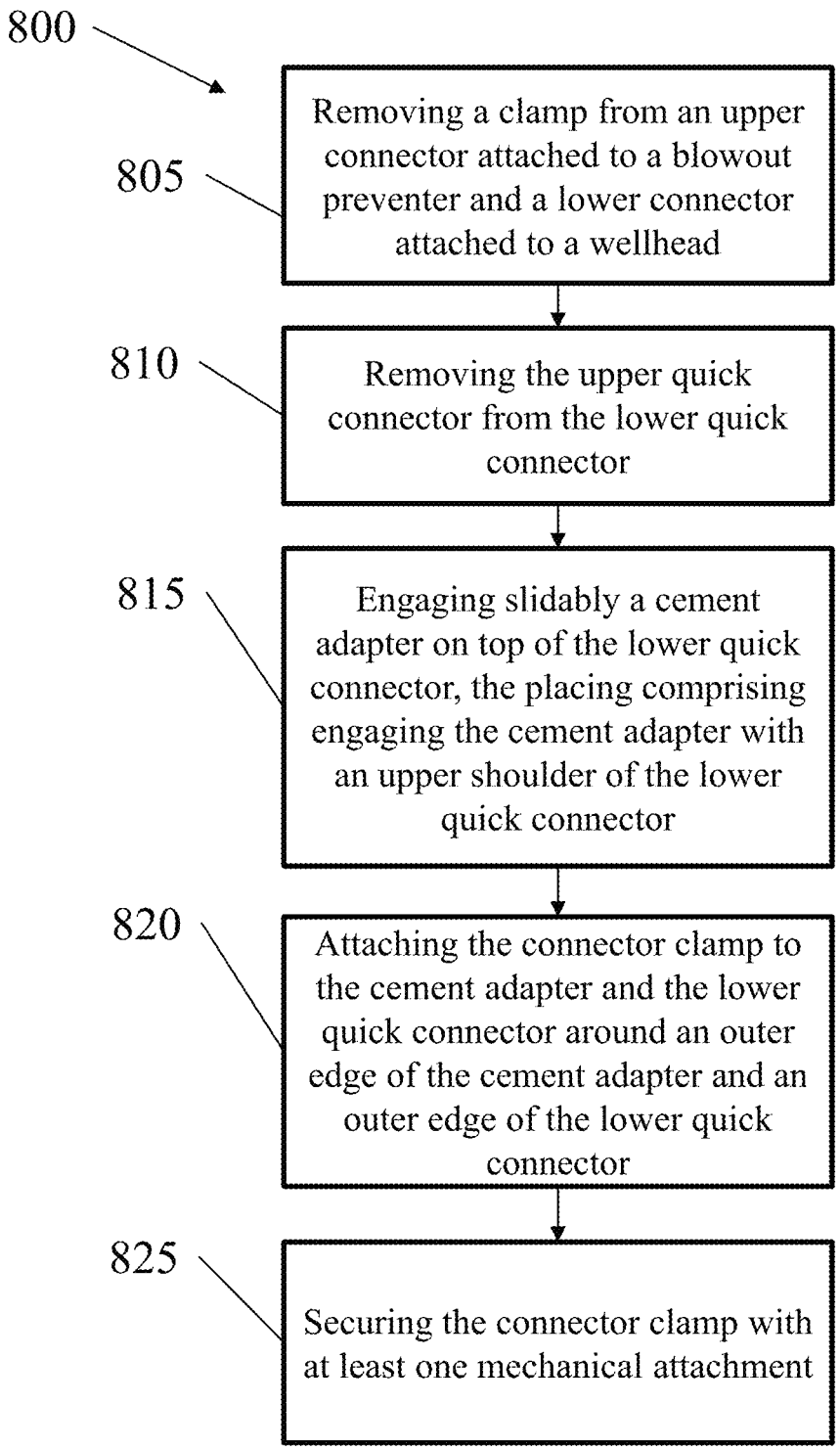
FIG. 14 is a flowchart of a method for adapting wellheads for offline cementing jobs according to embodiments of the present disclosure.

Turning to FIG. 14, a flowchart of a method for adapting blowout preventers for cementing jobs according to embodiments of the present disclosure is shown. Such methods 800 may include removing (block 805) a connector clamp from an upper quick connector that is attached to a blowout preventer and a lower quick connector that is attached to a wellhead. Removing the connector clamp may include removing one or more bolts, or other mechanical attachments, which are inserted through eye holes in connection portions that are disposed around the quick connectors. By removing the mechanical attachments, the connector portions may separate from the quick connectors, thereby providing access to such components.

Method 800 may also include removing (block 810) the upper quick connector from the lower quick connector. The upper quick connector is normally attached to the blowout preventer and is removed from the lower quick connector by removing the clamp and lifting the blowout preventer off the wellhead. If not connected to a blowout preventer, Removing the upper quick connector from the lower quick connector may include attaching one or more bolts having an eyehole, hook, or other attachment mechanism to the upper quick connector. A chain, cable, rope, or the like may then be attached to the bolts and the upper quick connector may be lifted off the lower quick connector. Depending on the type of upper quick connector, the number of bolts used in removing the upper quick connector may vary.

Method 800 may further include engaging (block 815) slidably a cement adapter on top, i.e., up hole, of the lower quick connector. The placing includes engaging the cement adapter with an upper shoulder of the lower quick connector. Because the cement adapter may slide into the lower quick connecter, the attachment of the cement adapter may be relatively faster than other types of attachments that are used. Alternative attachments may require various mechanical attachments including bolts, threads, and the like, which may make the process take longer than the embodiments provided in the present disclosure.

In certain embodiments, the placing of the cement adapter may also include initially securing the cement adapter to the lower quick connector by tightening at least one mechanical attachment temporarily. The mechanical attachment may be inserted through the cement adapter and into the lower quick connect and when the connection is completed, the mechanical attachment may be removed. This initial securing of the cement adapter to the lower quick connector is not sufficient to hold the components together during operation.

Method 800 may also include attaching (block 820) the connector clamp to the cement adapter and the lower quick connector around an outer edge of the cement adapter and an outer edge the lower quick connector. The attaching may include placing two or more connection portions around the outer edges of the components. As discussed above, the connection portions may include eyeholes, or other apertures through such attachment mechanisms may be inserted.

Method 800 may also include securing (block 825) the connector clamp with at least one mechanical attachment. The securing may include inserting the mechanical attachment through the eyeholes and tightening the connector clamp such that the connector portions secure the cement adapter to the lower quick connector. After the cement adapter is secured to the lower quick connector, a cementing device may be attached to the cement adapter and cement may be pumped into a well that is connected to the blowout preventer.

In certain embodiments, advantages of the present disclosure may provide systems and methods to fabricate subsea connectors directly onto a substrate, such as a pipe, for use in hydrocarbon drilling and production operations.

In certain embodiments, advantages of the present disclosure may provide systems and methods that allow for faster transitions between wellhead components during cementing operations.

In certain embodiments, advantages of the present disclosure may provide systems and methods that allow slidable engagement of cement adapters for use with wellhead that may make transitioning between components more efficient.

In certain embodiments, advantages of the present disclosure may provide systems and method that decrease labor costs associated with cementing operations.

In certain embodiments, advantages of the present disclosure may provide systems and methods that increase the speed of offline cementing operations.

Note that embodiments may exhibit one, none, or all of the advantages mentioned above. Furthermore, embodiments may not all manifest any given advantage to the same extent or degree as other embodiments.

The foregoing description, for purposes of explanation, used specific nomenclature to provide a thorough understanding of the disclosure. However, it will be apparent to one skilled in the art that the specific details are not required in order to practice the systems and methods described herein. The foregoing descriptions of specific examples are presented for purposes of illustration and description. They are not intended to be exhaustive of or to limit this disclosure to the precise forms described. Obviously, many modifications and variations are possible in view of the above teachings. The examples are shown and described in order to best explain the principles of this disclosure and practical applications, to thereby enable others skilled in the art to best utilize this disclosure and various examples with various modifications as are suited to the particular use contemplated. It is intended that the scope of this disclosure be defined by the claims and their equivalents below.

What is claimed is:

1. A system for connecting a cement string for a cementing operation to a wellhead assembly comprising a blowout preventer fluidly connected to a casing spool, which is fluidly connected to a casing head, which is fluidly connected to a wellhead casing, the system comprising:

a connector clamp;

an upper quick connector removably engaging the connector clamp;

a lower quick connector for removably coupling the connector clamp to the casing spool;

a cement adapter for removably engaging with the connector clamp when the upper quick connector is removed from engagement with the connector clamp, the cement adapter including a cement adapter body and defining a pressure port disposed through the cement adapter body; and a cementing device for removably coupling with the cementing adapter when the cement adapter is engaged with the connector clamp for delivering liquid cement to the wellhead casing through the casing spool and the casing head.

2. The system of claim 1, wherein the cement adapter is configured to slidably insert into the lower quick connector with a portion of the cement adapter received within the casing spool.

3. The system of claim 1, wherein the cement adapter comprises an intermediate string cement adapter.

4. The system of claim 1, wherein the cement adapter comprises a production cement adapter.

5. The system of claim 1, wherein the cement adapter includes a cement adapter body and defines a plurality of threads on a proximate inner edge of the cement adapter body for engaging the cement string.

6. The system of claim 1, wherein the cement adapter further comprises a cement adapter body having an outer edge that engages at least one sealing element and a radial protrusion extending outwardly from the cement adapter body.

7. The system of claim 6, wherein the connector clamp comprises at least one mechanical attachment to hold the cement adapter body and the lower quick connect in place.

8. The system of claim 6, wherein the cement adapter comprises at least one sealing element on the outer edge of the cement adapter body.

9. The system of claim 6, wherein the cement adapter defines at least one aperture proximate an outer edge of the cement adapter body.

10. A cement adapter for fluidly connecting cementing operation equipment to a wellhead assembly comprising a blowout preventer fluidly connected to a casing spool, which is fluidly connected to a casing head, which is fluidly connected to a wellhead casing, the cement adapter comprising:

a cement adapter for removably engaging with a connector clamp when an upper quick connector is removed from engagement with the connector clamp, and the blowout preventer is removed from fluid connection with the casing spool, the cement adapter including:

a radial extension to engage an inner surface of the lower quick connector and an inner edge of the connector clamp:

a plurality of apertures on a top portion of the cement adapter body to receive a corresponding plurality of attachments for installing and uninstalling the cement adapter body: and at least one sealing element on the outer edge of the cement adapter, the cement adapter for removably engaging with a cementing device when the cement adapter is engaged with the connector clamp for delivering liquid cement to the wellhead casing through the casing spool and the casing head.

11. The cement adapter of claim 10, wherein the cement adapter is configured to slidably insert into the lower quick connector with a portion of the cement adapter received within the casing spool.

12. The cement adapter of claim 10, wherein the cement adapter comprises an intermediate string cement adapter.

13. The cement adapter of claim 10, wherein the cement adapter comprises a production cement adapter.

14. A wellhead assembly comprising:

a blowout preventer;

a casing spool fluidly connected to the blowout preventer;

a casing head fluidly connecting the casing spool to a wellhead casing;

a connector clamp;

an upper quick connector removably coupling the connector clamp to the blowout preventer;

a lower quick connector removably coupling the connector clamp to the casing spool;

a cement adapter for removably engaging with the connector clamp when the upper quick connector is removed from engagement with the connector clamp, and the blowout preventer is removed from fluid connection with the casing spool, the cement adapter including a cement adapter body and defining a pressure port disposed through the cement adapter body; and a cementing device for removably coupling with the cementing adapter when the cement adapter is engaged with the connector clamp for delivering liquid cement to the wellhead casing through the casing spool and the casing head.

15. The wellhead assembly of claim 14, wherein the cement adapter slidably inserts through the lower quick connector with a portion of the cement adapter received within the casing spool.

16. The wellhead assembly of claim 14, wherein the cement adapter comprises an intermediate string cement adapter or a production cement adapter.

17. The wellhead assembly of claim 14, wherein the cement adapter defines a plurality of threads on a proximate inner edge of the cement adapter body for engaging the cement string.

18. A system for connecting a cement string for a cementing operation to a wellhead assembly comprising a blowout preventer fluidly connected to a casing spool, which is fluidly connected to a casing head, which is fluidly connected to a wellhead casing, the system comprising:

a connector clamp;

an upper quick for removably engaging the connector clamp;

a lower quick connector for removably coupling the connector clamp to the casing spool;

a cement adapter for removably engaging with the connector clamp when the upper quick connector is removed from engagement with the connector clamp, the cement adapter including:

a cement adapter body having an outer edge that engages at least one sealing element and including a radial protrusion extending outwardly from the cement adapter body; and the at least one sealing element on the outer edge of the cement adapter body; and a cementing device for removably coupling with the cementing adapter when the cement adapter is engaged with the connector clamp for delivering liquid cement to the wellhead casing through the casing spool and the casing head.

19. The system of claim 18, wherein the cement adapter is configured to slidably insert into the lower quick connector with a portion of the cement adapter received within the casing spool.

20. The system of claim 18, wherein the cement adapter comprises an intermediate string cement adapter.

21. The system of claim 18, wherein the cement adapter comprises a production cement adapter.

22. The system of claim 18, wherein the cement adapter includes a cement adapter body and defines a plurality of threads on a proximate inner edge of the cement adapter body for engaging the cement string.

23. The system of claim 22, wherein the connector clamp comprises at least one mechanical attachment to hold the cement adapter body and the lower quick connect in place.

24. The system of claim 22, wherein the cement adapter defines at least one aperture proximate an outer edge of the cement adapter body.

* * * * *